United States Patent [19]

Peter

[11] Patent Number: 4,990,882

[45] Date of Patent: Feb. 5, 1991

[54] PUSH-BUTTON ACTUATED OVERLOAD PROTECTION SWITCH

[75] Inventor: Josef Peter, Altdorf, Fed. Rep. of Germany

[73] Assignee: Ellenberger & Poensgen GmbH, Altdorf, Fed. Rep. of Germany

[21] Appl. No.: 487,887

[22] Filed: Mar. 5, 1990

[30] Foreign Application Priority Data

Apr. 3, 1989 [DE] Fed. Rep. of Germany ... 8904063[U]

[51] Int. Cl.[5] ..... H01H 71/16

[52] U.S. Cl. ..... 337/66; 337/57; 337/74

[58] Field of Search ..... 337/66, 67, 68, 69, 337/70, 71, 72, 73, 74, 75, 57, 62

[56] References Cited

U.S. PATENT DOCUMENTS

| | | | |
|---|---|---|---|
| 3,501,729 | 3/1970 | Brackett | 337/66 |
| 3,697,915 | 10/1972 | Brassard | 337/74 |

FOREIGN PATENT DOCUMENTS

| | | |
|---|---|---|
| 0081290 | 6/1983 | European Pat. Off. . |
| 763876 | 5/1953 | Fed. Rep. of Germany . |
| 1035747 | 8/1958 | Fed. Rep. of Germany . |
| 1563862 | 4/1970 | Fed. Rep. of Germany . |
| 2123765 | 5/1972 | Fed. Rep. of Germany . |
| 2923562 | 12/1980 | Fed. Rep. of Germany . |
| 8806964 | 1/1989 | Fed. Rep. of Germany . |
| 1497408 | 10/1967 | France . |

*Primary Examiner*—H. Broome

*Attorney, Agent, or Firm*—Spencer & Frank

[57] ABSTRACT

A push button actuated excess current protection switch, particularly an on-board electrical system protection switch with manual actuation and bimetal controlled automatic tripping includes a switch latch (7) actuated by the push button (41) and a bimetal tripping device for releasing the switch latch (7) with the bimetal tripping device including a self-heated approximately U-shaped punched bimetal (101) which is connected electrically in series in the current path through the switch. The one free arm end (102) of the bimetal is fastened to the end of a connecting lug (5) fixed in the interior of the switch housing. Its second free arm end (104) is fastened to a connecting piece (106, 106') leading to a mating contact (9') that is fixed to the housing. The base (114) is formed by the deflectable end of the bimetal which is kinematically connected with the switch latch.

Between the connecting flap (105) of the connecting piece (106, 106') for the second arm end (104) of the bimetal (101) and the region of the connecting piece (106, 106') adjacent the mating contact that is fixed to the housing, the connecting piece is provided with a constriction (111) formed by a slit passing through the plate-shaped central section of the connecting piece (106, 106') transversely to the plane of the plate. The connecting flap (105) is rotatable, in order to adjust the response value of the bimetal (101), around the constriction in that an adjusting screw (110) charges the central section from the bottom face of the switch housing.

13 Claims, 11 Drawing Sheets

D
45
46
41
43
42'
63
57
16
58
55
40
62
4
18
17
44
54
47
42
3
19
56
48
15
21
60
61
11
49
20
114
50
110
76
14
51
78
77
84
V
70
7
74
24
79
71
85
75
81
80
72
83
115
12
73
82
26
113
8
9
103
28
25
104
105
10
1

5
106
110
6
31
13
117
118

PUSH-BUTTON ACTUATED OVERLOAD PROTECTION SWITCH

BACKGROUND OF THE INVENTION

The invention relates to a push-button actuated overload protection switch and, in particular, to an on-board electrical system protection switch with manual actuation and bimetal controlled automatic tripping.

Known overload protection switches comprise a housing, a switch latch trippable by a push-button for bringing a contact bridge into a contact closing position and a contact opening position relative to mating contacts fixed to the housing; and a bimetallic tripping device for releasing the switch latch, including a self-heating bimetal in the form of an approximately U-shaped punched member which is electrically connected in series to the path of current through the switch. The free end of one arm of the U-shaped punched member is fastened to one end of a connecting lug fastened within the housing of the switch. The free end of the second arm is fastened to a connecting piece to which one of the mating contacts is attached. The base of the U-shaped punch member of the bimetal is deflectable in response to current flowing therethrough and is kinematically connected with the switch latch.

Such overload protection switches are disclosed, for example, in DE-C 2,123,765 and EP-A 0,081,290. In these switches, the bimetal of the bimetal tripping device is disposed essentially parallel to the narrow side wall of the switch housing, when viewed from the direction of pressure (D) applied to the push-button. Adjustment is effected by means of an adjustment screw which passes through a bore in this side wall and acts laterally and directly onto the bimetal and on its connecting foot.

The accuracy of the bimetal adjustment in the prior art switches leaves something to be desired. Moreover, direct charging of the bimetal and its connecting foot should be avoided.

In the overload protection switch disclosed in U.S. Pat. No. 3,697,915, there is already an improvement in this respect. In this device the connecting lug and the region adjacent the mating contact fixed to the housing on a connecting piece are tightly held in an accurate fit in corresponding bearing recesses in the housing. Moreover, the bimetal is not directly charged, but the connecting piece in the region within the housing is charged by an adjustment screw inserted laterally into the switch housing. In order to facilitate the adjustment displacement of the part of the connecting piece that is disposed in the interior of the housing, a reduction in cross section in the form of recesses in the lateral faces of the connecting piece is provided between the region where the connecting piece is fixed to the housing and the region where it is charged by the adjustment screw.

Furthermore, DE-U-88 06 964.8 discloses an electrical overload switch in which the strip-shaped bimetal is fastened to a connecting piece that is likewise held tightly and in a precise fit in corresponding supporting gaps in the housing. This connecting piece has an extension which is charged by an adjustment screw from the opposite side of the switch housing to adjust the response value of the bimetal.

SUMMARY OF THE INVENTION

Based on the above-described prior art overload protection switches, it is the object of the invention to further improve a push-button actuated overload protection switch of the above-mentioned type with respect to the adjustability of the bimetal.

The instant invention achieves the above object by providing a constriction between the connecting flaps of the connecting piece for the second arm end of the bimetal and the region of the connecting piece adjacent the mating contact fixed to the housing. The constriction is formed by a slit penetrating the plate-shaped central section of the connecting piece transversely to the plane of the plate. By means of an adjustment screw, the connecting flap can be charged so as to rotate around the constriction in order to adjust the response value of the bimetal. With this type of structure, the tripping value of the bimetal can be adjusted in a particularly sensitive and accurate manner by tensioning the two arms of the bimetal relative to one another.

The constriction provides the further advantage that the heat generated by the bimetal itself for tripping flows off less quickly from the bimetal into the adjacent conductor portions of the component. Thus, the set tripping value is better reproducible and is less subject to fluctuations.

Further advantageous embodiments of the slit and the support of the adjustment screw in the housing will be described with reference to the drawings. The slit may be an arcuate punched-out section in the late-shaped section of the connecting piece which can be produced at the same time when the connecting piece is punched out. The adjustment screw is held captive in the housing by means of a radially projecting ring on its head which is supported in a groove in the housing.

The extension of the connecting lug, according to the invention, at its end within the housing and its accurately fitting, tight seat in a corresponding recess in the housing fixes the bimetal component even better in the housing.

Another feature of the instant invention is a bimetal tripping device which includes two bimetals. Thus it is possible to employ a self-heating bimetal device even for small rated currents. Moreover, this device does not provide lower tripping forces than one-piece bimetals. The sandwich construction of the device according to the invention makes the entire bimetal device very compact to be placed and used essentially like a one-piece bimetal. An insulating layer between the two bimetals shields the latter against one another in such a manner that the full current path through the total length of the two bimetals remains in effect.

A further, structurally simple sandwich construction is possible according to the invention which is distinguished by a reliable and durable connection between the two bimetals in the form of welding, soldering or the like. A further advantage for manufacturing and storage reasons is that the two bimetals have identical shapes.

The meander-shaped configuration of the arms and base of the U-shaped bimetals enables the rated response current to be drastically reduced further, with the dimensions of the bimetals essentially remaining unchanged. In order to compensate for the mechanical weakening of the bimetal by the meander-like configuration of its arms and its base, clamp-like reinforcements can be placed onto the above-mentioned bimetal sections with appropriate insulating layers therebetween. Thus, a bimetal device of this type has essentially unchanged mechanical characteristics.

A so-called fail-safe arrangement for the switch can be advantageously integrated in the connecting piece in the bimetal device of the instant invention.

According to the invention, the connecting lug, one or several bimetals, the connecting piece which, if required, may be provided with a fail-safe arrangement, and the adjustment screw can be combined into a preassembled component which can be installed in the switch as a unit. With respect to automatic manufacture, this also results in advantages in assembly of the switch.

Another advantageous modification according to the invention of the bimetal component can realize a rapid response of the bimetal tripping device at high currents, in particularly the case of a short circuit.

A U-shaped extension of the connecting piece which flanks the U-shaped bimetal on its sides creates a so-called "current loop" in which the appropriate electrical and mechanical connections of the free end of the extension with the corresponding end of the arm of the bimetal causes the current flowing through these two components to flow in opposite directions in the respective sections. According to the known laws of electrodynamics, this results in a repulsion between the extension of the connecting piece and the bimetal. Since the connecting piece and its extension are fixed in the housing, the repelling forces act fully on the bimetal which, in addition to its normal deflection due to heating, is additionally and primarily deflected from its rest position into the tripping direction immediately upon the onset of a high current.

Due to the layer of insulation between the extension of the connecting piece and the bimetal, these two components can be positioned particularly closely adjacent one another without the danger of an electrical short circuit so that a particularly high repulsion effect with the shortest conceivable tripping time is realized.

It must be emphasized that with low currents, as they occur in the case of an overload, the dynamic effect of the "current loop" does not come to bear or only to a negligible degree. It is here solely the bending of the bimetal due to heating which trips the overload protection switch.

BRIEF DESCRIPTION OF THE DRAWINGS

Further features, details and advantages of the invention can be found in the description below in which various embodiments of the invention are described in greater detail with reference to the attached drawing figures. It is shown in.

DESCRIPTION OF THE PREFERRED EMBODIMENTS

Figure 1:
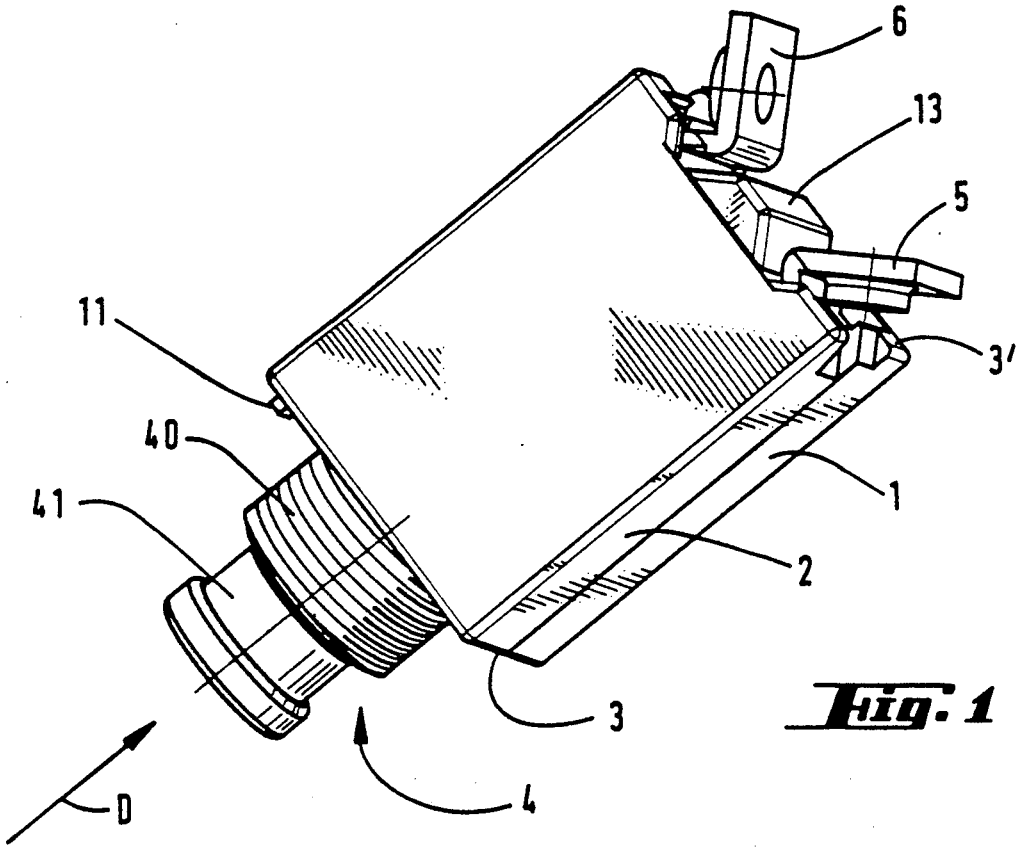
FIG. 1, a perspective illustration of the exterior of the overload protection switch according to the invention.

FIG. 1 shows an exterior view of the switch according to the invention. This switch includes an approximately block shaped housing of insulating material composed of two housing half-shells (1, 2) at whose narrow side wall (3) at the frontal end there is inserted the threaded neck (40) of a push-button component (4) and its push button (41) which is guided therein so as to be longitudinally displaceable in the direction of an applied pressure (D). The two angled connecting lugs (5, 6) project from the switch housing at its oppositely disposed narrow side wall (3') at the bottom end of the switch.

Figure 2:
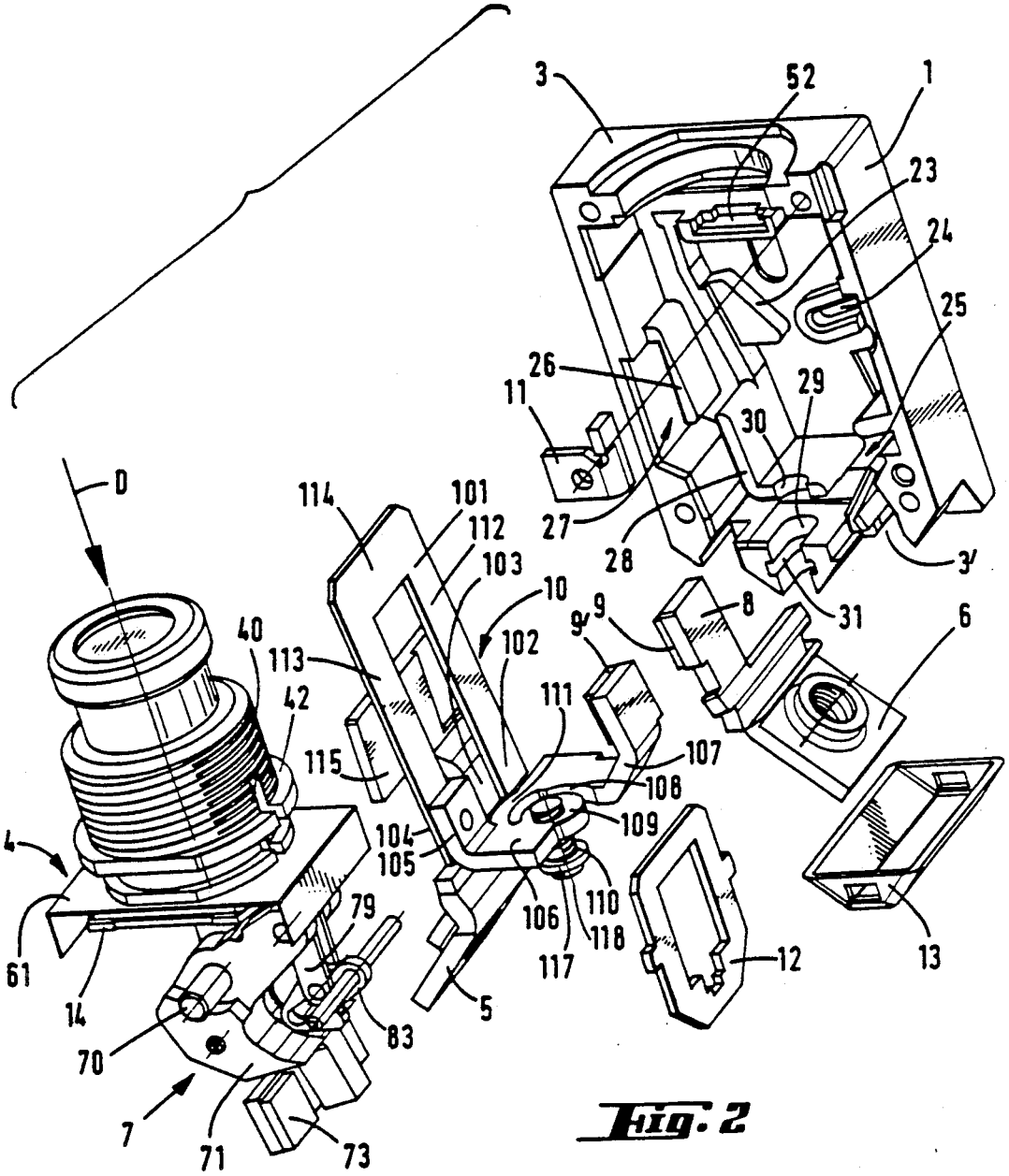
FIG. 2, a perspective exploded illustration of the switch according to the invention showing the various components inside the switch separated into functional groups.

FIG. 2 shows the various functional components that are integrated in the switch. In addition to the push-button component (4), a switch latch (7) and a bimetal component (10) which is electrically and mechanically connected to one connecting lug (5) are held within the switch. FIG. 2 further shows, released from the above mentioned components, the second connecting lug (6) which is provided with an extension (8) disposed within the housing with a mating switch path contact (9) when the lug (6) is fixed to the housing. In the lateral edge region of the upper narrow side wall (3), an arresting tab (11) is held so as to be rotatable between the two housing half-shells (1, 2). This tab can be brought into engagement with a groove (42) at the exterior of the threaded neck (40) and constitutes a protection against rotation of the threaded neck (40) and the switch itself when it is installed in a switching panel. Also, a frame-like tripping lever (12) which constitutes a kinematic connecting element between the switch latch (7) and the bimetal component (10) and an adjustment cover (13) is snapped onto the lower narrow side wall (3').

The core piece of the bimetal group (10) is the flat, U-shaped punched and bent bimetal (101) whose one free arm end (102) is fastened to an extension (103) of the connecting lug (5) in the interior of the housing. The second free arm end (104) of U shaped bimetal (101) is welded to an upwardly bent connecting flap (105) of a connecting piece (106) which at its diametrally oppositely disposed end is provided with a likewise upwardly bent extension (107) providing the second mating contact (9') fixed to the housing for the switching path. The two mating contacts (9, 9') have their contact faces disposed in a plane extending transversely to the parting groove plane between the two housing half-shells (1, 2) and approximately parallel to the direction of an applied pressure (D). At an approximately central position, the connecting piece (106) is provided with an arcuate cutout (108) in whose center a threaded bore (109) has been formed. From the narrow side wall (3') at the bottom, of the switch, an adjustment screw (110) is screwed into this bore 109 and can be rotated so as to tilt the connecting member (106) about a constriction (111) formed by the cutout (108), thus tightening the two arms (112, 113) of the bimetal (101) relative to one another in order to adjust the tripping value of the bimetal (101). The base (114) of the U-shaped bimetal (101) constitutes a deflectable end whose deflecting movement is transferred to the switch latch (7) by a transfer slide (14) disposed in the housing transversely to the direction of an applied pressure (D) below push-button component (4). The trip lever (12) is disposed in communication with the transfer slide (14) so as to trip the latch when the slide moves in response to the deflected end of bimetal (101).

The switch is switched on and off manually by means of the push button (41) of push button component (4) which will be described in greater detail below with reference to FIGS. 3 to 6. The essentially cylindrical push button (41) is made of an insulating material and is provided with a blind-bore-like bearing recess (43) that opens toward the interior of the housing and extends in the direction of pressure (D) so as to additionally guide the push button in the direction of pressure (D) on a guide member that is anchored in the housing. The guide member is formed jointly by a cap-shaped formed member (44) made of an insulating material, a coil-like push button spring (46), which is clamped in between the formed member (44) and the bottom (45) of the bearing recess (43) on the actuation side, and a supporting member (47) which when viewed in a longitudinal section in the direction of pressure has the shape of the letter U. The two U-arms (48, 49) of the supporting member are oriented in a direction opposite to the direction of pressure (D) and their free ends are in engagement with the formed counter-bearing member (44). In the region of the peak between its U-arms (48, 49) and the base (50) of the U, the supporting member (47) is provided with laterally projecting flaps (51) which are supported at a corresponding housing tab (52) (FIG. 2). Thus supporting member (47) and formed counter-bearing member (44) are held in the housing in fixed position. On its facing side walls parallel to the direction of pressure, the formed counter-bearing member (44) is provided with downwardly open guide slits for the shaft (55). These slits extend in the direction of pressure (D). Due to their configuration, the supporting member (47) and the formed counter-bearing member (44) themselves constitute guide (53) extending in the direction of pressure (D) for a supporting lever (15) which extends essentially in the direction of pressure (D) and whose end (16) near the push button is connected by way of a turn-push joint connection, with the end of push button (41) in the interior of the housing. This joint connection is created by the passage of the shaft (55) held at two lateral projections (54) of the push button (41) through the cam-like long hole (17) in the push button side end (16) of the supporting lever (15). The long hole (17) has an angular shape whose arm (18) oriented from the apex of the angle in the direction opposite to and parallel to the direction of pressure (D) and an arm (19) oriented in the direction of pressure (D) extends at an acute angle is oriented in a direction opposite to the latch engagement direction (20) (see FIG. 4). On its side near the long hole (17), the supporting lever (15) is provided with a catch projection (21) which, due to the displaceability of the supporting lever (15) in the direction of pressure (D) and its pivotability transversely to this direction, can be brought into latching engagement with a catch recess (56) in one of the U-arms (48, 49) of the supporting member (47).

The end of the supporting lever (15) oriented in the direction of pressure (D) is connected by way of a pivot axis (70) with the switch latch (7) of the switch. The central component of this switch latch (7) is the L-shaped contact bridge carrier (71) which is displaceable in the direction of pressure (D) and pivotal in a pivot plane parallel to the direction of pressure. The peak region of the contact bridge carrier is connected by way of the pivot joint formed by the axis of rotation (70) with the end of the supporting lever (15) in the interior of the housing. In the region of its free end, the contact bridge arm (72) extending approximately in the direction of pressure (D) supports the contact bridge (73) which is disposed transversely to the direction of pressure and serves to bridge the two mating contacts (9, 9') that are fixed to the housing. This contact bridge is articulated to contact bridge carrier (71) by way of a pivot connection (74). The pivot connection (74) is additionally charged in the contact closing direction by a contact pressure spring (75) in the form of a leg spring.

The contact bridge carrier (71) is charged in the direction opposite to the contact closing direction by a turn-off spring (77) seated o the pivot axis (70) and configured as a double leg spring. The turn-off spring (77) is here supported, on the one hand, on a sloped projection (23) (FIG. 2) o the interior faces of housing half-shells (1, 2) and, on the other hand, on the upper side of a latch arm (76) extending transversely to the direction of pressure (D).

At the free end (78) of the latch arm (76), there is articulated one end of an articulated lever (79) whose opposite free end (80) is fixable in a lock (V). For this purpose, the free end (80) of the articulated lever (79) has a shaft (81) that extends transversely to the direction of pressure (D) and, on the one hand, engages in a passage opening (82) extending in the longitudinal direction in a pivotal latch lever (83) mounted in the housing and, on the other hand, is guided at its end so as to be laterally displaceable in housing grooves (24) which extend approximately transversely to the direction of pressure (D). At its end away from the switch latch, the passage opening (82) is given an angled configuration (84) into which the shaft (81) in cooperation with the guide can be latched in the housing grooves (24) The pivotal latch lever (83) which is charged by the leg spring (85) in the latching direction, is in kinematic connection with the bimetal (101) by way of the trip lever (12) and the transfer slide (14). The deflection of the bimetal is converted by way of the transfer slide (14) and the trip lever (12) into a pivotal movement of the latch lever (83) in the direction opposite to the latch engagement direction so that the shaft (81) is released from its lock.

The operation of the switch according to the invention will now be described.

Figure 3:
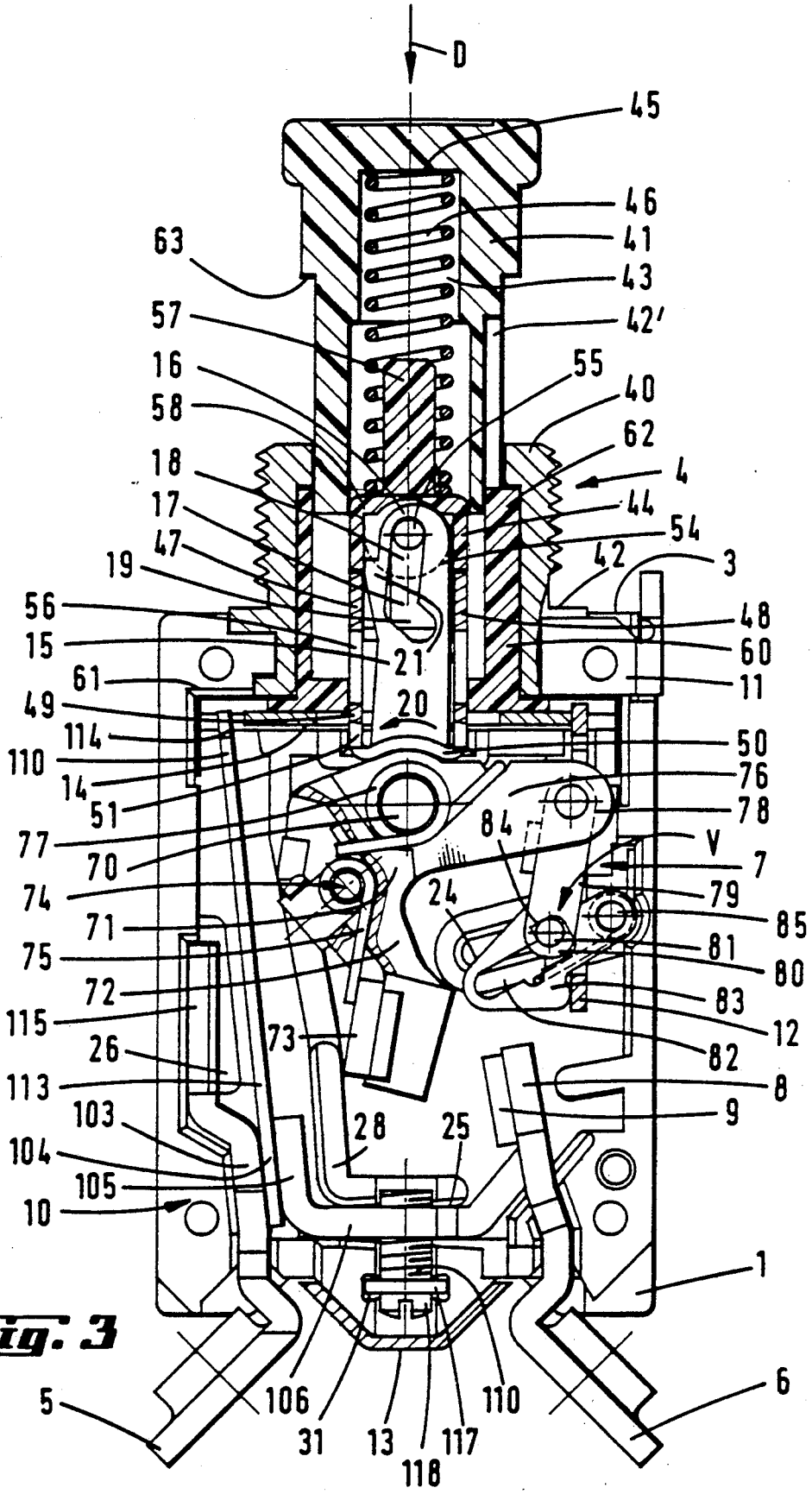
FIGS. 3 to 5, longitudinal sectional views of the switch of the invention along the parting groove between the two housing half-shells showing the off, on and overload positions, respectively of the switch latch.
Figure 4:
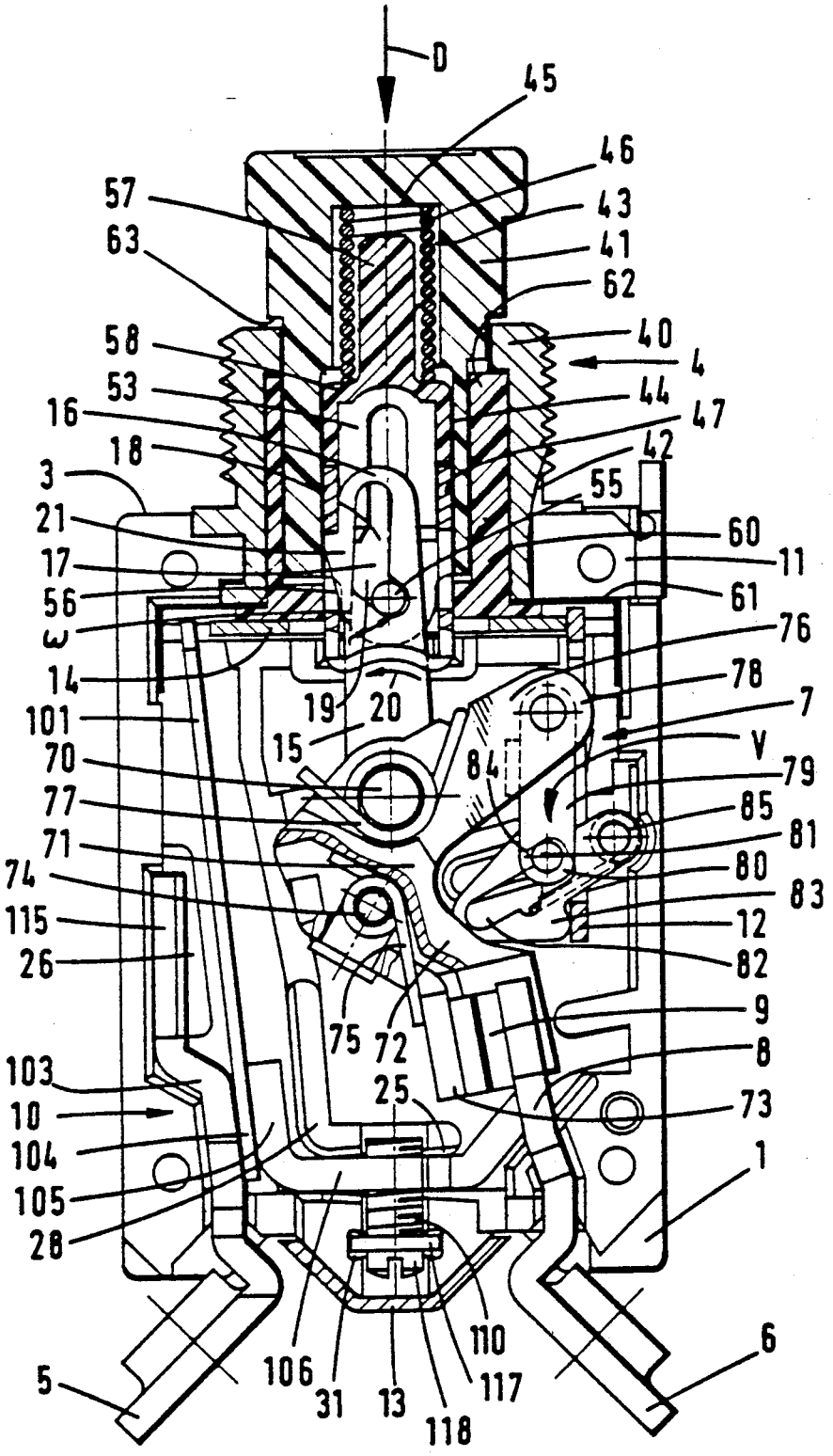

FIG. 3 shows the switch in its turn-off position. If the push button is actuated, the shaft (55) moves along the arm (18) of the long hole (17) extending parallel to the direction of pressure until it hits the lower side edge of the arm of the long hole extending obliquely to this direction. Beginning with this position, the supporting lever is also moved in the direction of pressure (D) and is simultaneously charged transversely thereto. As soon as the latch projection (21) at supporting lever (15) is in congruence with the latch recess (56) at the supporting member (47), the supporting lever (15) is pivoted counterclockwise relative to FIG. 3 and latch projection (21) engages in latch recess (56). The displacement of the supporting lever (15) in the direction of pressure (D) simultaneously causes the contact bridge carrier (71) to perform a turning-pushing movement into a position in which the contact bridge (73) is in the turn-on position (FIG. 4). By the latching of the support lever (15) and the connected fixing of the axis of rotation (70) relative to the contact bridge carrier (71) and the lock (V), the contact bridge (73) is fixed in the turn-on position. In this position, the shaft (55) of the push button (41) is retained in the obliquely extending lower arm of the long hole (17) since the push-button spring (46) is unable to charge the push button (41) and thus the shaft (55 with such a force opposite to the direction of pressure (D) that the lock between the latch projection (21) at the supporting lever (15) and the latch recess (56) in the terminating member (47) could be released. If, however, the push button (41) is pulled for turn-off, the charging of the sloped side edge of the long hole arm (19) by means of the shaft (55) causes the supporting lever (15) to be pivoted clockwise, the latch projection (21) to be pulled out of the latch recess (56) and thus this lock to be released. Thus the supporting lever (15) is able to move upward, carrying along the contact bridge carrier (71) and moves the contact bridge (73) into the off position (FIG. 3).

Figure 5:
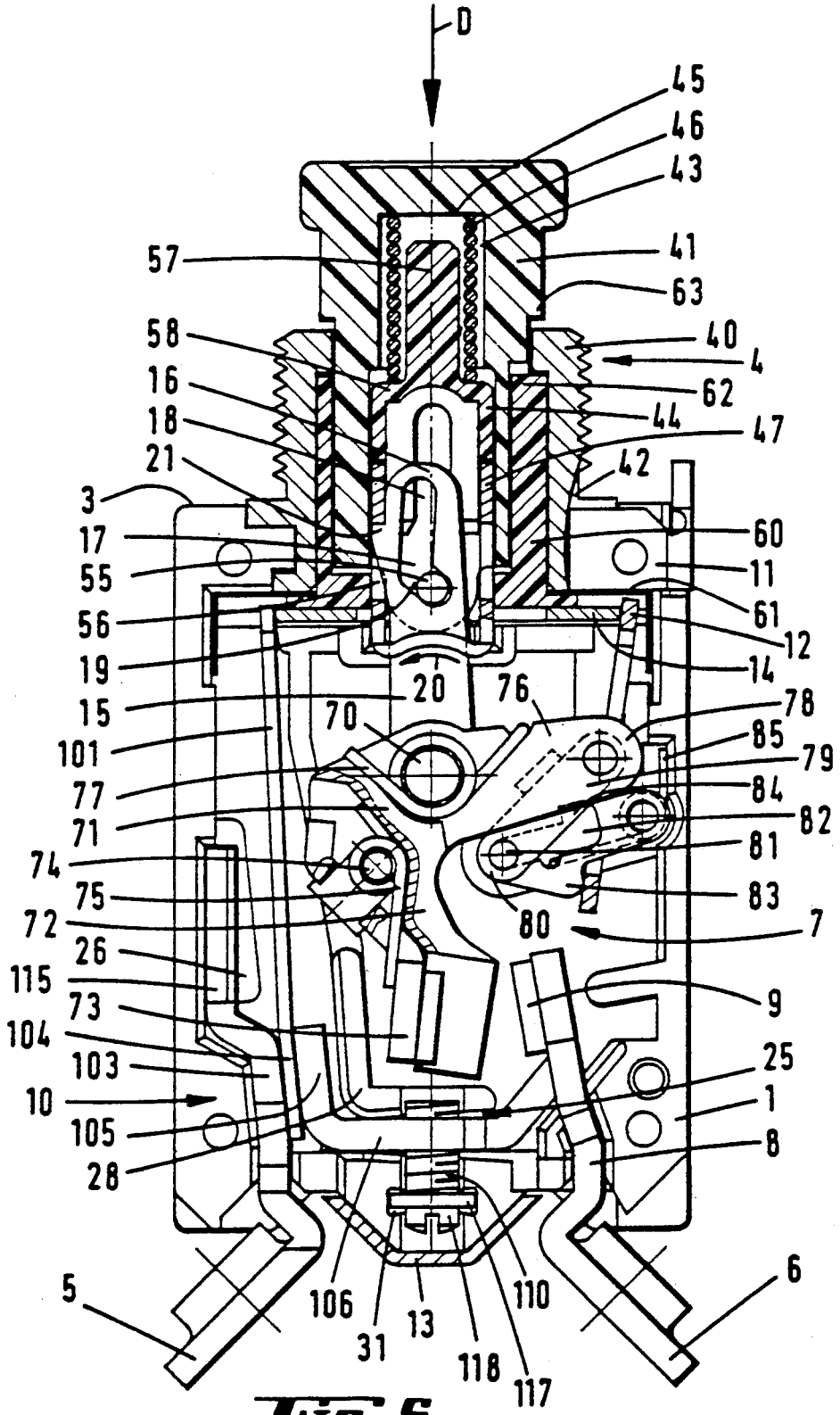

If the switch is tripped by the bimetal (101) due to an excess current, the contact bridge carrier (71) is released by a release of the lock (V) and turns, under the influence of the turn-off spring (77) clockwise relative to FIG. 5 about the rotation axis (70). Thus, the opening of the contact by lifting the contact bridge (73) from the mating contacts (9, 9') also is effective in the case in which the push button (41) is held in its turn-on position. Thus this is a truly an automatic tripping action.

Several details of the push-button component (4) will now be described with reference to FIGS. 3 to 6. The upper transverse wall (58) of the formed abutment member (44) is provided with a stub (57) which is formed to it in one piece and which engages from the bottom into the coil-type push button spring (46) and additionally guides it. The supporting lever (15) passes with lateral play through the base of the U (50) of the supporting member (47) by way of a transverse slit so that pivotability of the supporting lever (15) remains ensured. Moreover, a cylindrical insulating sleeve (60) is inserted between the threaded neck (40) and the push button (41) and at its lower end carries a plate-shaped insulating cover (61) extending transversely to the direction of pressure (D). The insulating cover defines the interior of the switch toward the push button side and is provided with a circular opening (68) which corresponds to the inner opening of the insulating sleeve (60).

At its inner wall flanking the push button (41), the insulating sleeve (60) is provided with a projection (62) which engages into a groove (42') in the outer wall of the push button in order to secure the push button (41) against rotation. Additionally, the push button is provided on its wall with a circumferential annular shoulder (63) which by abutting at the end face of the threaded neck (40) delimits the insertion movement of the push button when the latter is actuated.

The manner of fastening the bimetal component (10) in the housing and its adjustment will no be described with reference to FIGS. 2 to 5. The extension (103) of the connecting lug (5) in the interior of the housing is provided with a plate-like extension (115) which is held in the housing in a tight and accurate fit in a fixing pocket (27) formed by a lateral partition (26) in the housing half-shells (1, 2). Thus the extension (103) and consequently the fastening point for the bimetal arm (112) ar fixed in their position and precisely defined.

Likewise, the region of the connecting piece (106) adjacent the bent extension (107) equipped with the mating contact (9') is held in a tight and accurate fit in the bearing gap (25) between the narrow side wall (3') at the bottom and the formed angled portion (28) in the housing half-shells (1, 2) disposed in parallel thereto and in front of it. In addition to stable fixing of the bimetal component (10), the tight fit also results in a particularly stable position of the mating contact (9').

As already mentioned, the essentially plate-shaped connecting piece (106) is divided into two regions by an arcuate cutout (108), with the regions being connected by a constriction (111). The adjustment of the bimetal device is effected by means of the adjustment screw (110) which is inserted into a threaded bore (109) in the radial center of the cutout (108) of the connecting piece (106). Flush with this threaded bore (109), the narrow side wall (3') at the bottom is provided with an adjustment bore (29) in which lies the adjustment screw (110) and is accessible from the outside. On the opposite side of the adjustment bore (29), the angular formed-on projection (28) in each housing half-shell (1, 2) has a semicircular recess (30) in which the threaded end of the adjustment screw (110) is able to move freely. Approximately in its center on its interior wall, the adjustment bore (29) has an annular circumferential supporting groove (31) in which is supported the radially projecting ring (117) at the head (118) of the adjustment screw (110). As already mentioned, rotation of the adjustment screw (110) whose longitudinal axial direction is thus fixed causes the region of the connecting piece (106) disposed alongside the connecting flap (105) to be tilted by rotation about the constriction (111), thus tensioning the two arms (112, 113) of the bimetal (101) against one another and correspondingly changing the response value of the bimetal (101). After the adjustment, the adjustment screw (110) is set by attachment of the adjustment cover (13) in the form of a cap which is snapped onto the housing. The cover may be permanently connected with the housing, for example by ultrasonic welding, thus effectively preventing subsequent manipulation at the switch with respect to changing its set tripping value.

The constriction (111) simultaneously constitutes a thermal resistance which prevents that the heat required by the bimetal for its response flows too quickly from the bimetal (101) through the connecting flap (105) and the connecting piece (106) in the direction toward the mating contact (9'). Thus, fast responses and precise adjustability of the bimetal (101) are realized.

Figure 6:
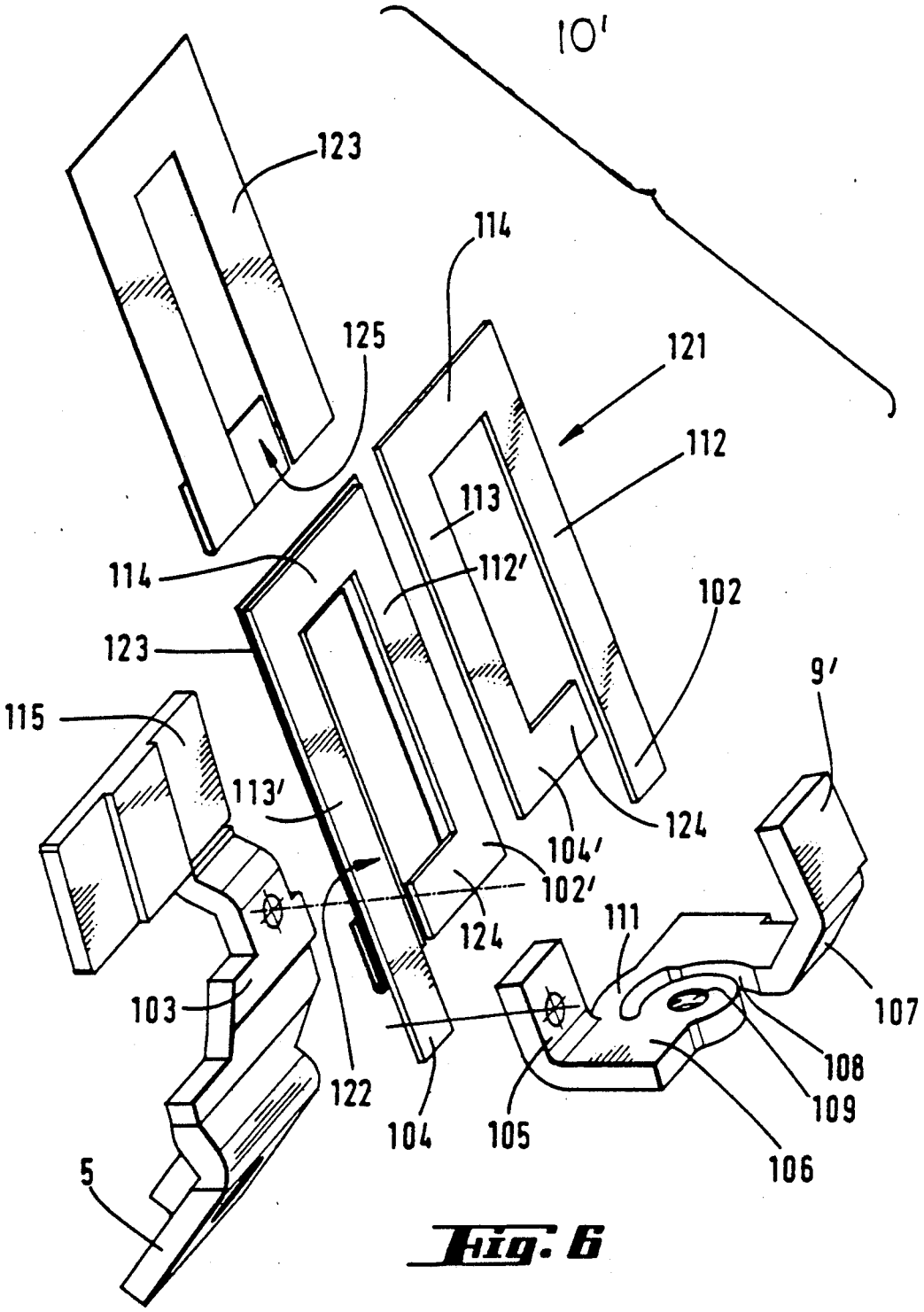
FIG. 6, a perspective exploded illustration of a bimetal device in a first alternative embodiment according to the invention.

FIG. 6 shows a first alternative embodiment (10') of the bimetal component in which, instead of one bimetal (101), two approximately U-shaped bimetals (121, 122) are employed. These are arranged face to face on top of one another in the manner of a sandwich structure with an insulating layer (123) between them. The one bimetal (121) has its free arm end (102) fastened to the connecting lug (5), while the second bimetal (122) has its free arm end (104) welded to the connecting flap (105). The remaining free arm ends (102', 104') of the two bimetals (121, 122) are provided with an inwardly oriented angled portion (124). As can be seen in FIG. 6, the two bimetals (121, 122) are identical in shape but are arranged in a mirror image so that their angled portions (124) cover one another when in the installed position.

In the overlap region, the identically shaped insulating layer (123) is provided with a recess (125) enabling the two angled portions (124) of the free arm ends (102', 104') to be welded together directly to thus establish a durable electrical and mechanical connection between the two bimetals (121, 122'). The latter are thus electrically connected in series. This results in a doubling of the current path through the bimetal device so that tripping is possible even at low rated currents. Due to the arrangement of the two bimetals (121, 122) on top of one another, the resulting tripping force remains essentially unchanged compared to the single bimetal (101). A further reduction of the rated tripping current is possible by making the bimetals thinner, in which case the sandwich structure serves to retain mechanical stability.

Figure 7:
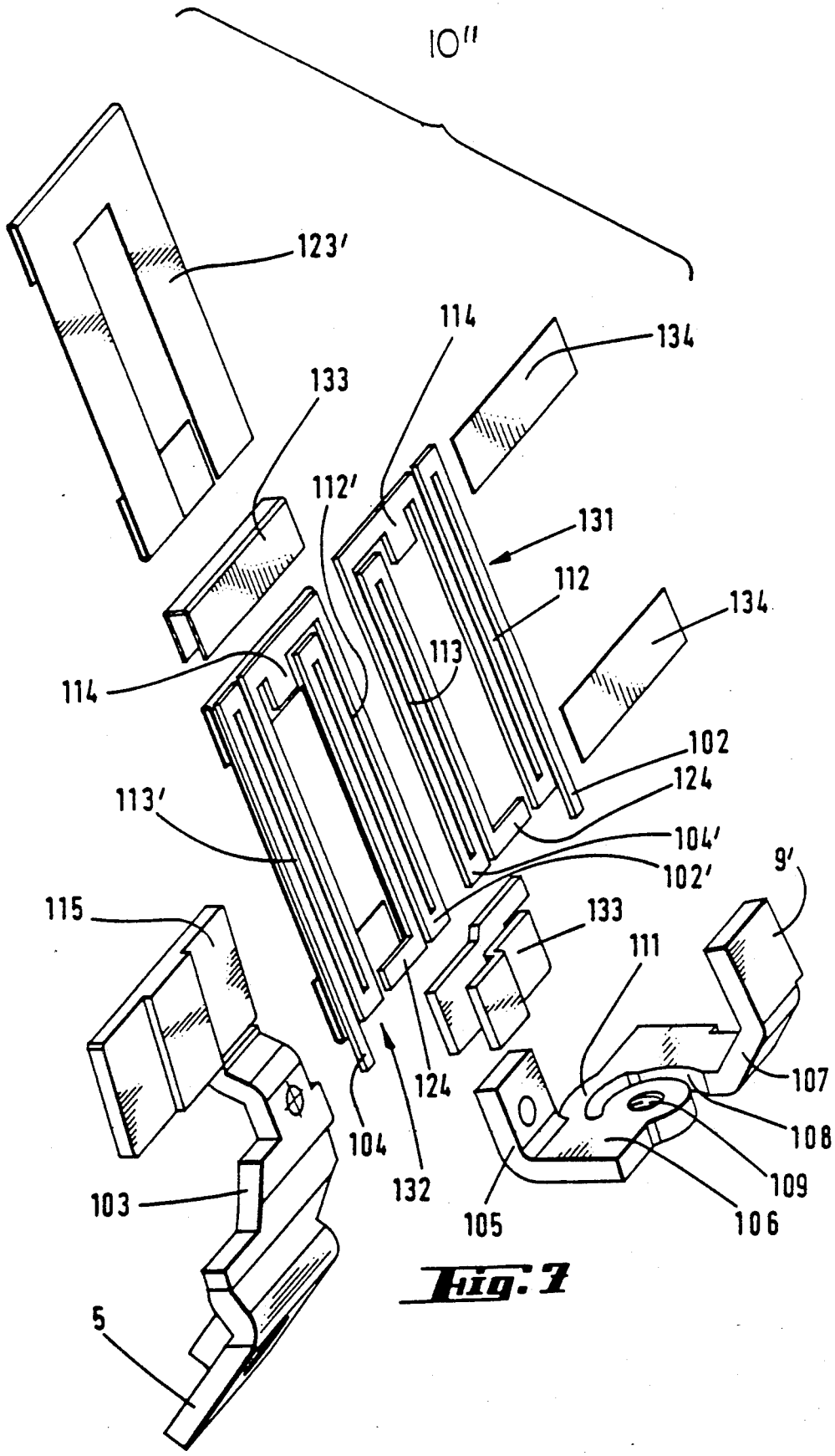
FIG. 7, a perspective exploded illustration of a bimetal device in a second, alternative embodiment of the invention.
Figure 8:
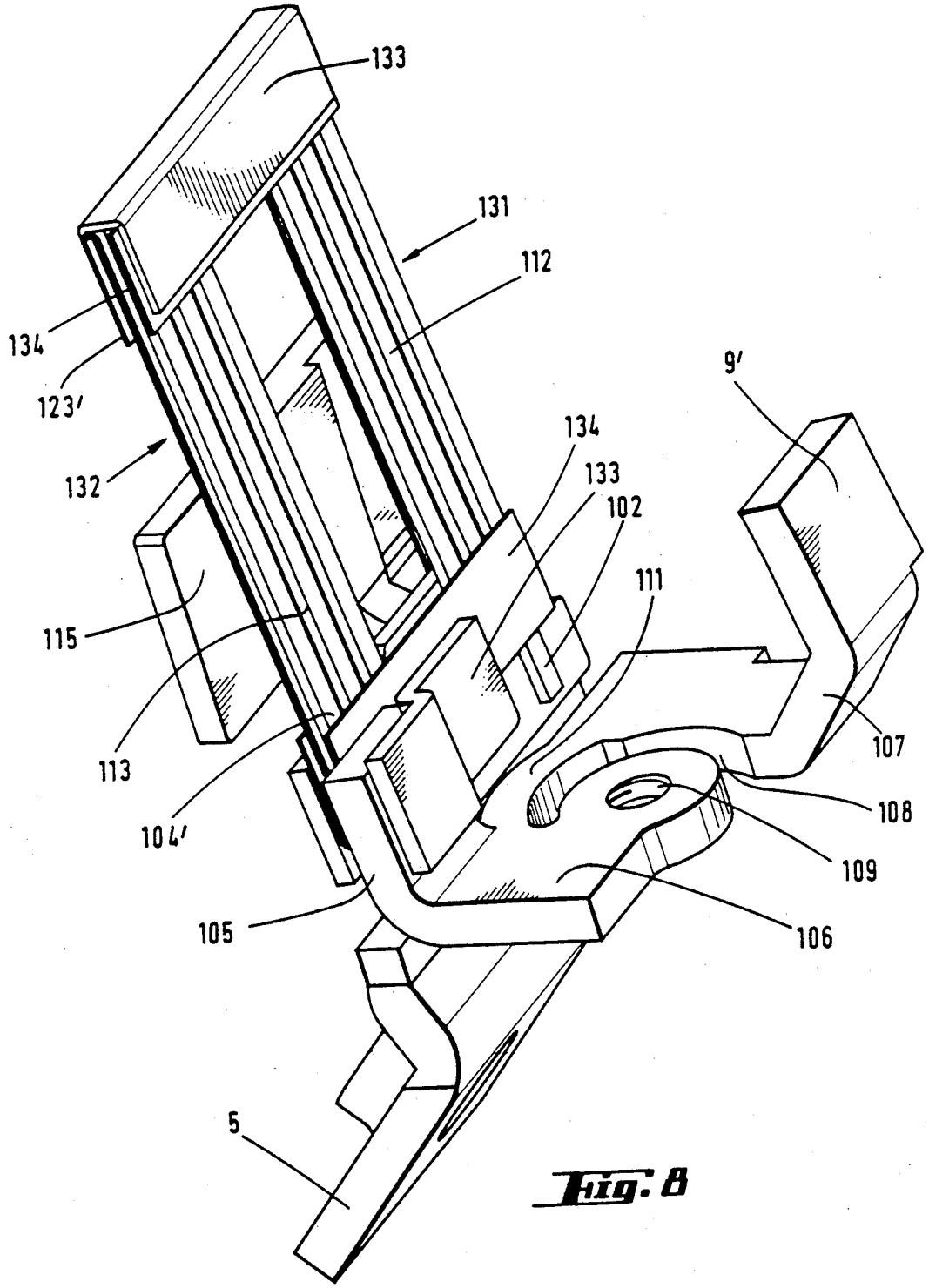
FIG. 8, a perspective illustration of the bimetal device of FIG. 7.

FIGS. 7 and 8 show a further alternative embodiment (10'') of the bimetal component in which two bimetals (131, 132) are employed whose arms (112, 113, 112', 113') are given a meander-like configuration by appropriate punching. This multiplies the current path through these two bimetals (131, 132), and consequently the rated tripping current is reduced to a fraction. The two bimetals (131, 132) are arranged analogously to the bimetals (121, 122) in a so-called sandwich structure with an insulating layer (123') between them. Their shape is also identical and they are installed in a mirror image position relative to one another. Their free arm ends (102, 104) are connected with the connecting lug (6) and with the connecting flap (105) and their free arm ends (102', 104') are connected with one another analogously to the bimetals (121, 122).

Since the bimetals (131, 132) are mechanically weakened by the meander-like shape of their arms, clamp-like reinforcements (133) are provided in the region of their base (114) and their free arm ends (102, 102', 104, 104'); these reinforcements are seated on the mentioned bimetal sections with further insulating plates (134) therebetween. Here again, the tripping force is almost unchanged compared to the single bimetal (101).

It must be pointed out that the adjustment of the alternative bimetal components (10', 10'') according to FIG. 6 or FIGS. 7 and 8 is effected analogously to the adjustment of the bimetal component (10) according to FIGS. 2 to 5.

Figure 9A:
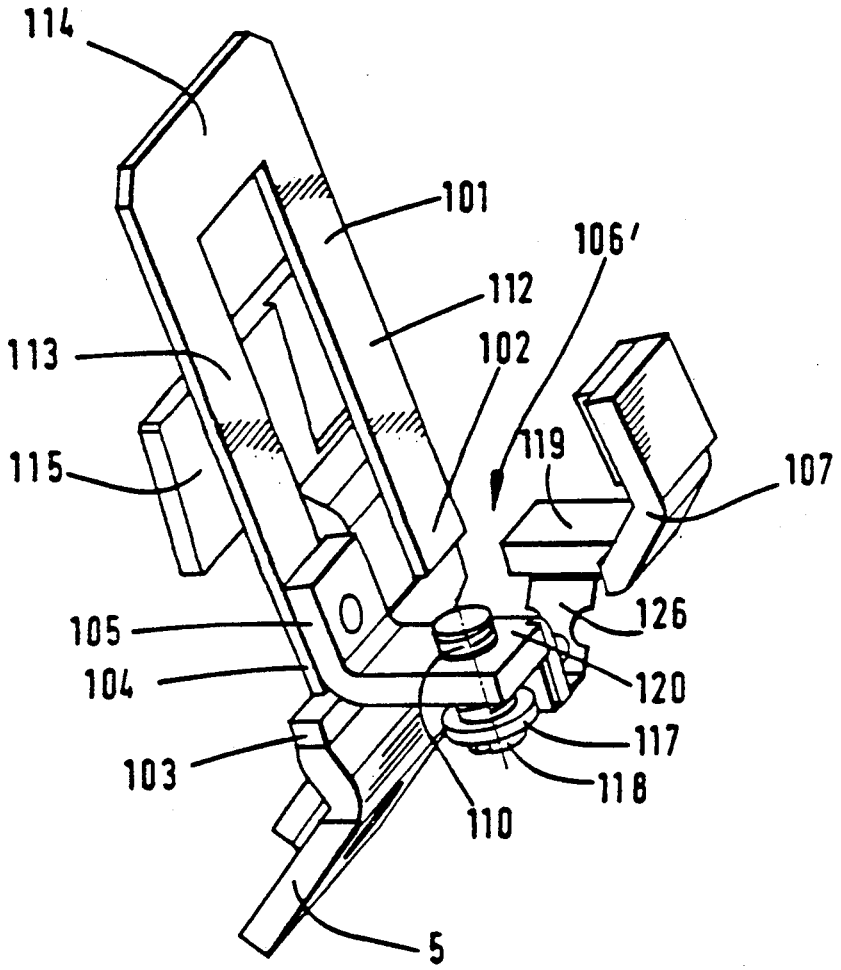
FIG. 9*a*, a perspective exploded illustration of a bimetal device with an integrated fail-safe arrangement according to the invention.
Figure 9B:
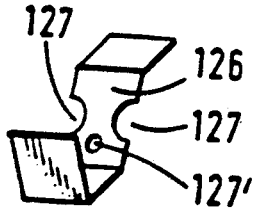
FIGS. 9*b* and 9*c*, an elevational view and a side view, respectively of the bridge of the bimetal device of FIG. 9*a*.
Figure 9C:
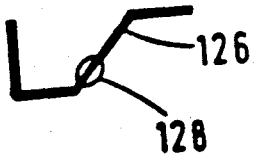

FIG. 9 shows a further alternative configuration (10''') of the bimetal component in which a so-called failsafe arrangement is provided. The principle of this failsafe arrangement is already known from EP-A 0,081,290. For this purpose, the connecting piece (106') is divided into two parts (119, 120) approximately in its center. These parts are electrically connected with one another by means of a thin sheet metal bridge (126). The sheet metal bridge simultaneously constitutes the flexible, rotatable component corresponding in function to the constriction (111) in the connecting member (106). Moreover, this sheet metal bridge is a meltable conductor which is provided with a plurality of cutouts (127) in order to reduce its conductive cross section. In the illustrated normal state of the switch, at least the central, circular cutout (127') is sealed with meltable solder (128) as shown in FIGS. 9*a* and 9*c*.

The mentioned fail-safe arrangement operates as follows:

If a normal current flows through the switch, neither the bimetal device nor the fail-safe arrangement responds. If an excess current flows, the bimetal (101) is bent outwardly and releases the lock (V) in the switch latch (7) by way of the transfer slide (14) and the trip lever (12) (FIG. 5). The contact bridge (73) of the switch should now move into its turn-off position and interrupt the flow of current through the switch. If for some reason this does not occur (defect in the switch latch, contacts welded together), the excess current continues to flow through the switch and causes the bimetal (101) and thus the connecting piece (106') to be heated further. After a short time, the connecting piece (106') and the sheet metal bridge (126) will reach such a temperature that the meltable solder (128) melts away. This causes the conductive cross section of the sheet metal bridge (126) to be reduced further which again results in a noticeable heating of the sheet metal bridge (126) and finally causes the sheet metal bridge (126) to melt through. Thus the flow of current through the switch is finally and irreversibly interrupted. The entire defective switch must be exchanged.

Figure 10:
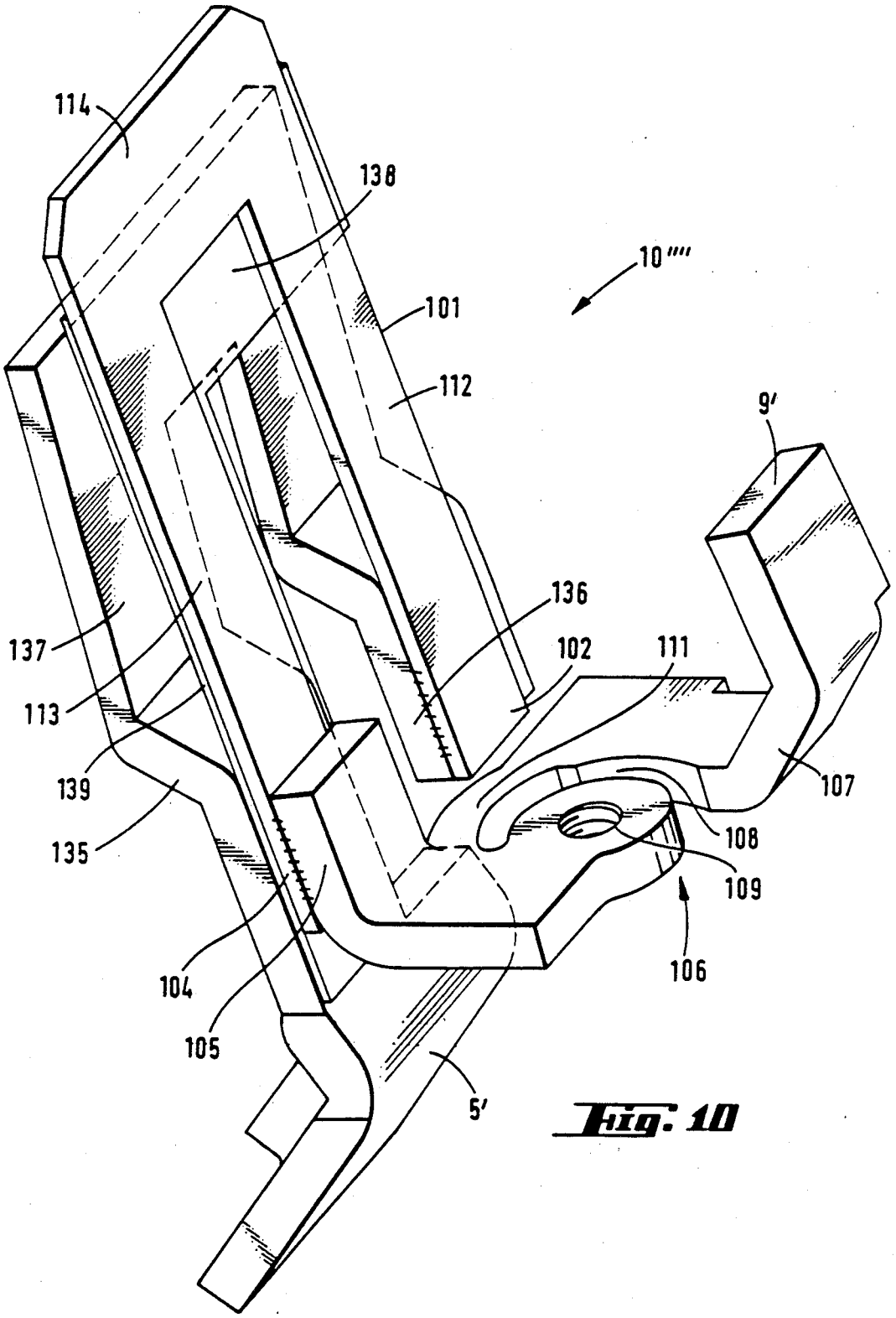
FIG. 10, a perspective illustration of a bimetal device wit "current loop"
Figure 11:
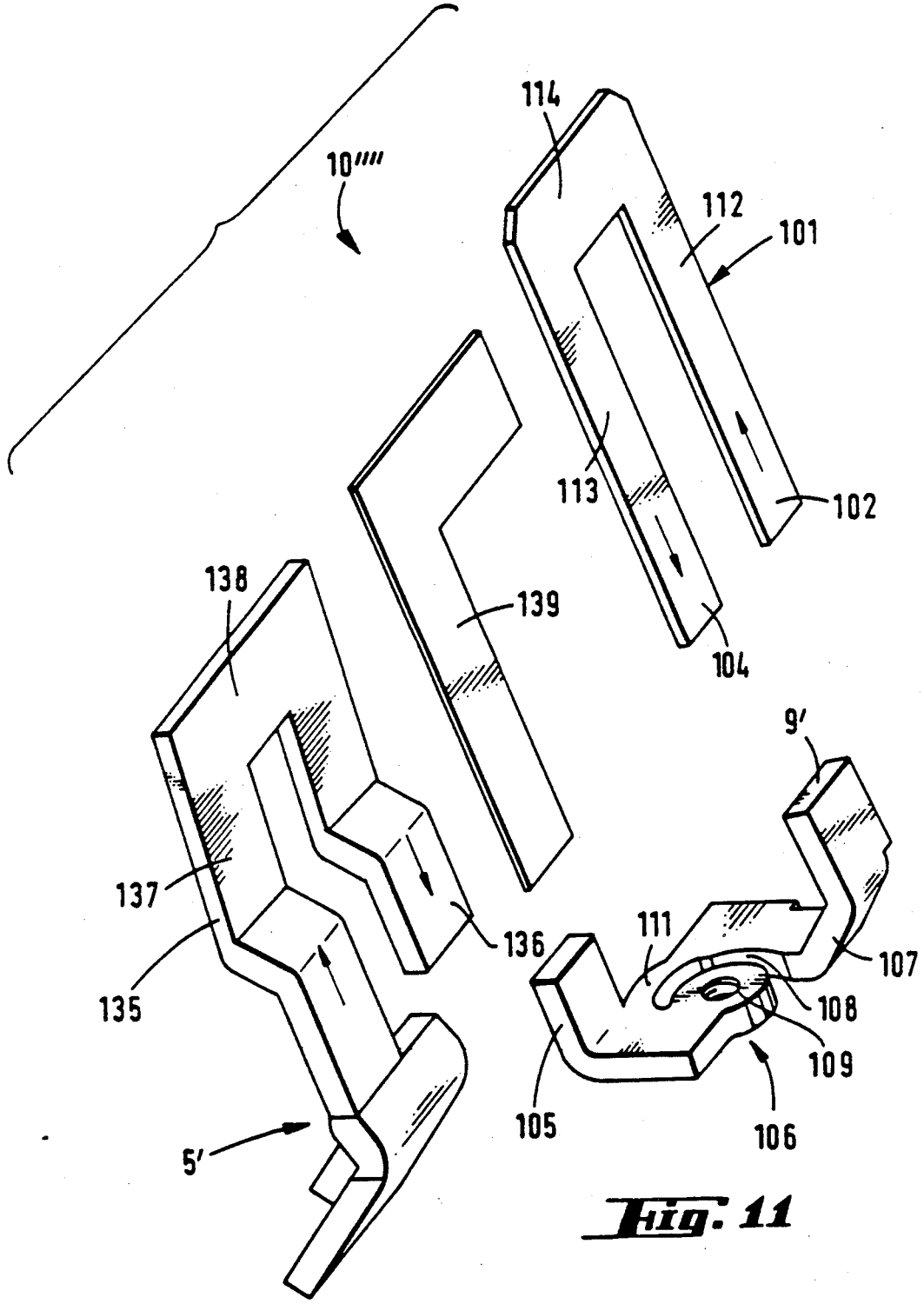
FIG. 11, a perspective exploded illustration of the bimetal device according to FIG. 10.

FIGS. 10 and 11 show a further alternative bimetal component 10'''' which has an improved tripping characteristic at high excess currents. In this bimetal component 10'''' the connecting piece 5' does not have a plate-shaped extension 115 as in the previous embodiments, but has a U-shaped extension 135 which flanks the U-shaped bimetal 101 on its sides. This means that, as viewed from the top onto the plane of the bimetal 101, the latter and the extension 135 are arranged to essentially overlap one another.

The free end 136 of extension 135 is welded to the free arm end 102 of bimetal 101. The second free arm end 104 of bimetal 101 is welded, analogously to the embodiment of FIG. 2, to the connecting flap 105 of connecting piece 106.

An L-shaped layer of insulating material 139 is inserted between the U-arm 137 attached to connecting lug 5 and the U-base 138 of extension 135 as well as between the U-arm 113 flanked by these components and the base 114 of bimetal 101.

The described construction results in the following current path. The current entering at connecting lug 5 flows through extension 135 in the direction indicated by the arrows. By way of the connecting point at the free ends 136, 102 of extension 135 and bimetal 101, respectively, the current enters into the latter and flows through bimetal 101 in the direction indicated by the arrows shown there; this direction is opposite to the current directions in the individual sections of extension 135. By way of the second free arm end 104 of bimetal 101, the current enters into connecting piece 106 and there reaches the mating contact 9' fixed to the housing for contact bridge 73.

In view of the oppositely oriented current directions in bimetal 101 and in extension 135, respectively, these two components strongly repel one another, particularly at high currents. In view of the fact that connecting lug 5' and its extension 135 are fixed in the housing, these repelling forces become fully effective as additional dynamic forces and act on the bimetal to bend it out in the tripping direction. This effect occurs, in particular, at currents over 1000 amperes. Thus a particularly fast turn-off time is realized in the case of a short circuit.

For smaller currents, the dynamic effect of the current loop arrangement does not become effective.

I claim:

1. An excess current protection switch with manual actuation and bimetal controlled automatic tripping, the switch comprising:

a housing having an opening on its bottom side;

two stationary mating contacts mounted within the housing;

a contact bridge movable between a contact closing position and a contact opening position relative to the two mating contacts;

a switch latch attached to the movable contact bridge for holding the contact bridge in and out of engagement with the two mating contacts;

a push button for tripping the switch latch and causing the contact bridge to move between the contact closing and opening positions;

a connecting piece comprising a plate, one of the two mating contacts extends from one side of the plate, a connecting flap extending from an opposite side of the plate, and a slit passing through the center of the plate, transversely to the plane of the plate and defining a constriction between the connecting flap and the side of the plate from which the mating contact extends; and a bimetallic tripping device, kinematically connected with the switch latch, said bimetallic tripping device including a substantially U-shaped self-heating bimetal having a base member constituting a deflectable end of the bimetal and two arm portions extending from the base member so that the free end of one arm portion is fastened to an end of a connecting lug held within the housing and the free end of the other arm portion is fastened to the connecting piece, whereby the bimetal is electrically connected in series with the path of the current through the switch and the bimetallic tripping device releases the switch latch from the contact closing position when the current flowing through the bimetal causes the base member to deflect, wherein the connecting flap can be rotated by an adjustment screw charging the center of the plate from the bottom side of the housing so as to adjust the response value of the bimetal.

2. An excess current protection switch according to claim 1, wherein the slit is formed by an arcuate cutout in the center of the plate of the connecting piece.

3. An excess current protection switch according to claim 2, wherein the connecting piece further comprises a threaded bore disposed centrally with respect to the arcuate cutout in the central section of the plate and, the adjustment screw being screwed into said threaded bore includes a head and a radially projecting ring disposed around the head which is supported in a groove of the housing.

4. An excess current protection switch according to claim 1, wherein the connecting lug is provided with a one-piece formed-on extension at its end within the housing, said extension being tightly held in a precise fit in a corresponding recess in the housing.

5. An excess current protection switch according to claim 1, wherein the bimetal tripping device includes two U-shaped bimetals and an insulating layer, said bimetals arranged face to face on top of one another defining a sandwich structure with the insulating layer being disposed therebetween; one of said bimetals being fastened with one of its free arm ends to the connecting lug and the other bimetal being fastened with one of its free arm ends to the connecting piece; said bimetals being electrically connected in series by means of an electrical connection between their remaining free arm ends.

6. An excess current protection switch according to claim 5, wherein each of said two bimetals further includes an inwardly angle portion connected to the remaining free arm end so that the bimetals overlap one another by way of the inwardly directed angled portions, the insulating layer being recessed in the overlapped region of the two bimetals so that a direct electrical connection is established between the overlapping arm ends by welding or soldering.

7. An excess current protection switch according to claim 1, wherein the arm portions and the base member of the at least one U-shaped bimetal has a meander-like shape.

8. An excess current protection switch according to claim 7, wherein the bimetallic tripping device further comprises clamp-like reinforcements and corresponding layers of insulating material, the clamp-like reinforcements are seated in the region of the free arm ends and the base member of the at least one bimetal through the intermediary of the corresponding layers of insulating material.

9. An excess current protection switch according to claim 1, wherein the connecting piece is divided approximately in its center into two partial sections to form the slit, and further comprises a thin sheet metal bridge connecting the two partial sections with one another to form the constriction and simultaneously act as a meltable conductor so as to provide a fail-safe arrangement for the switch.

10. An excess current protection switch according to claim 9, wherein the sheet metal bridge is provided with at least one cutout which, in the normal state of the switch, is closed with meltable solder in order to reduce the conductive cross section of the sheet metal bridge.

11. An excess current protection switch according to claim 1, wherein the connecting lug, the at least one bimetal, the connecting piece which is possibly provided with a fail-safe arrangement, and the adjustment screw are combined into a preassembled bimetal component which can be installed in the switch as a unit.

12. An excess current protection switch according to claim 1, wherein the connecting lug has a U-shaped extension fixed within the housing which flanks the arm portions and base member of at least one U-shaped bimetal and whose one free end is electrically and mechanically connected with the corresponding free arm end of the at least one bimetal.

13. An excess current protection switch according to claim 12, wherein the bimetallic tripping device further includes an L-shaped insulating layer which is inserted between the U-arm attached to the connecting lug and the U-base of the extension as well as between the U-arm flanked thereby and the base member of the bimetal.

* * * * *